United States Patent [19]

Carriveau

[11] Patent Number: 4,741,238

[45] Date of Patent: May 3, 1988

[54] SEMI-HOLLOW-BODY GUITAR APPARATUS

[76] Inventor: Ronald S. Carriveau, 2029 W. Elm, Phoenix, Ariz. 85015

[21] Appl. No.: 72,286

[22] Filed: Jul. 13, 1987

Related U.S. Application Data

[63] Continuation-in-part of Ser. No. 827,520, Feb. 10, 1986, abandoned.

[51] Int. Cl.[4] ..... G10D 3/00
[52] U.S. Cl. ..... 84/291
[58] Field of Search ..... 84/291, 293

[56] References Cited

U.S. PATENT DOCUMENTS 3,974,730 8/1976 Adams, Jr. ..... 84/291
4,450,748 5/1984 Shaus et al. ..... 84/291

*Primary Examiner*—L. T. Hix
*Assistant Examiner*—Brian W. Brown
*Attorney, Agent, or Firm*—H. Gordon Shields

[57] ABSTRACT

Semi-hollow-body guitar apparatus includes a guitar body having a cutout portion with structural bracing elements supporting a top for the body and with a bridge secured to the top and which bridge extends substantially the full width of the body. A pickup is disposed in a slot in the bridge beneath a saddle.

14 Claims, 1 Drawing Sheet

SEMI-HOLLOW-BODY GUITAR APPARATUS

CROSS-REFERENCE TO RELATED APPLICATION

This is a continuation-in-part application of copending application Ser. No. 827,520, filed Feb. 10, 1986, and now abandoned.

BACKGROUND OF THE INVENTION

1. Field of the Invention:

This invention relates to guitars, and, more particularly, to electric guitars utilizing acoustic pickups.

2. Description of the Prior Art:

In guitars of the prior art, there are primarily two types, solid body guitars and hollow body guitars. The solid body guitars are, of course, strictly electric guitars, with acoustic coupling not being a factor. Rather, pickups are designed to magnetically detect the vibration of steel strings and to transduce the magnetic output to sound. In acoustic type guitars, either steel strings or nylon strings vibrate over an acoustic chamber, which is the hollow guitar body, and an acoustic pickup can be utilized to transduce the vibrations into amplified sound. There are, of course, magnetic pickups which may also be utilized with acoustic guitars.

For acoustic guitars, the guitar body is generally made of relatively thin wood so that the entire guitar body, including the top, the sides, and the bottom, resonates with the vibrating air in response to the vibration of the strings. This is, of course, the general theory behind all string-type instruments. However, with the advent of electronics, guitars having magnetic pickups, and thus not requiring acoustic chambers, have been developed.

U.S. Pat. No. 3,974,73O (Adams) discloses an acoustic guitar with a particular internal bracing system. Except for the bracing system, this patent exemplifies acoustic or hollow body guitars, with the relatively thin wall construction, the open acoustic chamber, and the sound hole through the guitar top.

When hollow body acoustic guitars are used, there are apertures in the top plate to provide access for the air within the acoustic chamber of the guitar. Solid body guitars do not require openings because they do not have acoustic or resonating sound chambers. In solid body guitars, the only chambers within the guitar body are for the housing of pickups, controls, etc., and are not for the purpose of sound modification.

U.S. Pat. No. 4,450,748 (Shaw et al) discloses a solid body guitar with a false sound hole and several cavities in the body for containing various electronic components. The guitar apparatus also includes a chamber or cavity beneath the bass side of the bridge to allow the bass side of the bridge to move and flex. None of the chambers or cavities is for the purpose of modifying sound or providing a resonating chamber.

SUMMARY OF THE INVENTION

The invention described and claimed herein comprises a semi-hollow-body guitar utilizing a resonating or acoustic sound chamber in which the walls of the sound chamber are relatively thick so that the walls of the sound chamber, including the bottom and the top, do not vibrate with the air trapped within the chamber in response to the vibration of strings. Structural bracing elements are utilized to support the relatively thick top for the sound chamber. The bridge for the guitar is disposed over the acoustic center of the sound chamber and is secured to the top, and it extends substantially the full width of the sound chamber.

Among the objects of the present invention are the following:

To provide new and useful guitar apparatus;

To provide new and useful semi-hollow-body guitar apparatus;

To provide new and useful guitar apparatus having an enclosed sound chamber;

To provide new and useful semi-hollow-body guitar apparatus having relatively thick walls for a sound chamber;

To provide new and useful guitar apparatus having a bridge extending substantially the entire width of the guitar body;

To provide new and useful guitar apparatus having an acoustic pickup secured to the bridge; and To provide new and useful guitar apparatus having internal bracing for supporting the top plate of the guitar and for securing the top plate of the guitar to the sides of the guitar.

DESCRIPTION OF THE PREFERRED EMBODIMENT

Figure 1:
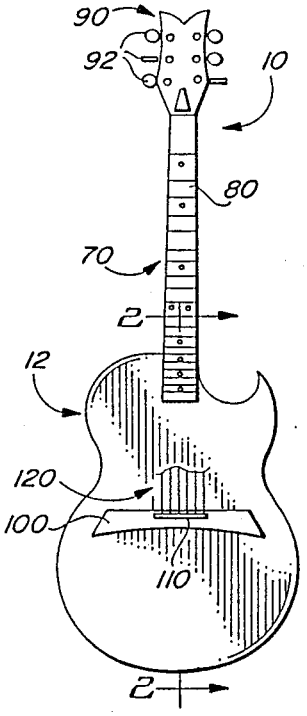
FIG. 1 is a top view of the apparatus of the present invention.

FIG. 1 is a top view of guitar apparatus 10 embodying the present apparatus. The major portions of the guitar apparatus 10 are illustrated in FIG. 1. They include a body 12, a neck 80, and a head 90.

The body 12 is made from a relatively solid block of wood 14 in which an acoustic or resonating sound chamber 16 is carved by removing a substantial amount of the wood. The block is thus cut down to comprise a relatively traditional "fiddle" shaped body, or traditional guitar-shaped body, with certain deviations.

Figure 3:
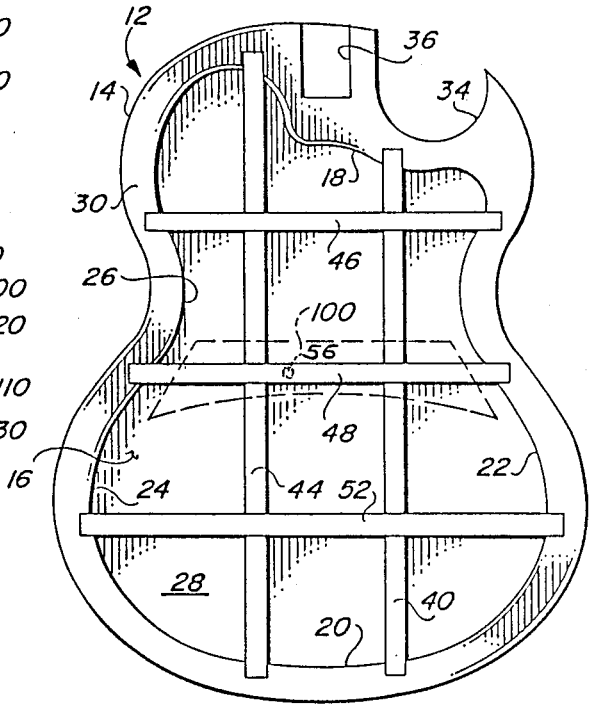
FIG. 3 is an enlarged view of a portion of the apparatus of the present invention.
Figure 4:
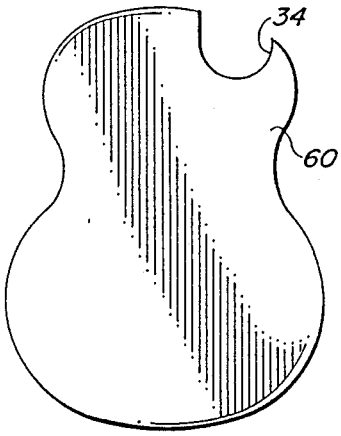
FIG. 4 is a top view of a portion of the apparatus of the present invention.
Figure 5:
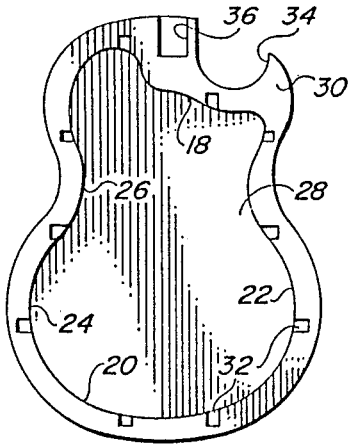
FIG. 5 is a top view of a portion of the apparatus of FIG. 3.
Figure 7:
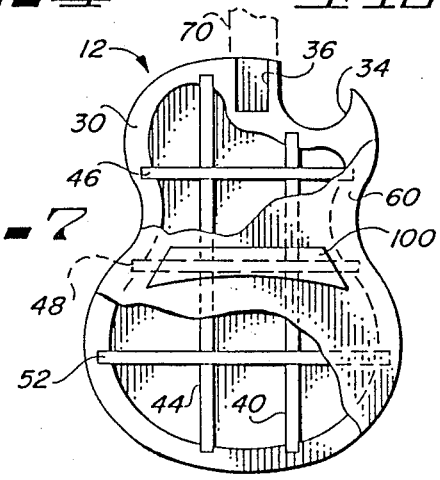
FIG. 7 is a top view, partially broken away, of a portion of the apparatus of the present invention.
Figure 8:
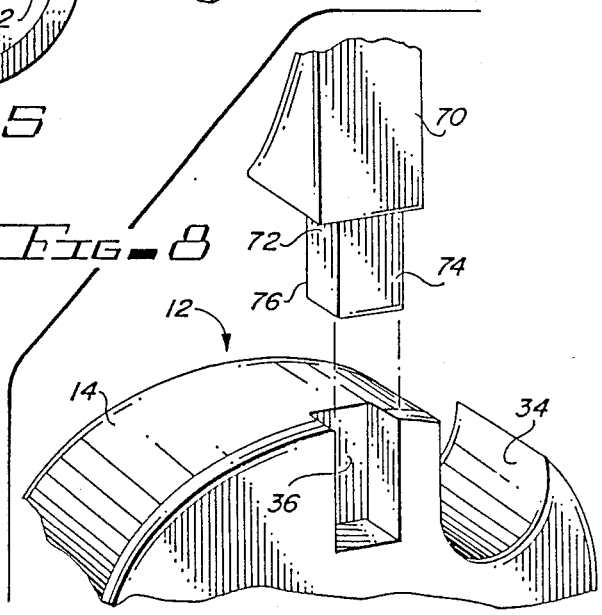
FIG. 8 is a partially exploded perspective view of a portion of the apparatus of the present invention.

The sound or acoustic chamber 16 is defined by continuous and integral wall elements. The wall elements include a top wall 18 which is curved in a series of irregular concave curves, as is best shown in FIGS. 3, 5, and 7. Remote from the wall 18 is a bottom wall 20 which comprises a relatively gentle or regular concave curve. Between the top wall 18 and the bottom wall 20 are a pair of side walls 22 and 24. the side walls 22 and 24 are also relatively gently rounded to comprise a "pinched waist" configuration, or a pair of concave inner configurations on each wall. The pairs of concave shapes are divided at an inwardly extending waist portion 26.

The bottom wall 20 and the side walls 22 and 24 blend into each other in a continuous curve, and both the side walls 22 and 24 also blend in with the top wall 18. However, the top wall 18 has an irregular configuration on the inside, because of an indentation 34 in the exterior of the block 14 and a notch 36 which receives the neck 70.

The walls 18, 20, 22, and 24 extend upwardly from a bottom 28. The bottom 28 and the walls 18, 20, 22, and 24 are relatively thick to minimize their vibration.

The block 14 also includes a top surface 30. The top surface 30 is generally flat, and defines a plane or planar surface on which a top 60 is disposed and to which the top 60 is secured.

Extending downwardly from the top surface 30 is a plurality of notches 32. The notches 32 are aligned in pairs to receive a plurality of braces which cross or bridge the top of the acoustic chamber 16.

The plurality of braces which comprise the structural support on the top of the acoustic chamber 16 for the guitar top 60 include a pair of vertical or longitudinal braces 40 and 44, and three transverse braces 46, 48, and 52. The ends of the braces 40, 44, 46, 48, and 52 extend into the notches 32, and the respective braces are themselves notched so that they may be secured to each other where they cross each other and so that they may further provide an even, uniform or flat, planar top surface for receiving the top 60.

A brace or bar 56 extends from the bottom of the brace 48 to the bottom 28. The brace or bar 56 is appropriately secured in place, as by gluing. The lateral location of the brace 56 is shown in FIG. 3. Laterally, the brace 56 is preferably located between the fourth and fifth strings. This will be discussed in more detail below. The brace 56 may be round or square, etc., as desired.

Figure 6:
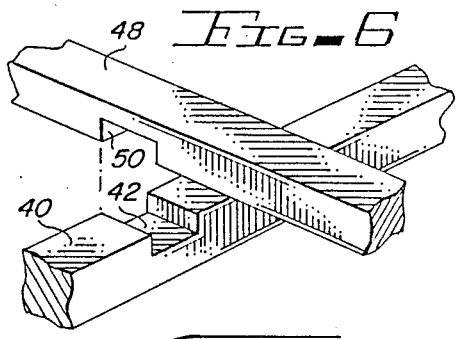
FIG. 6 is an exploded perspective view of a portion of the apparatus of the present invention.

FIG. 6 is an exploded perspective view of the braces 40 and 48. The brace 40 is a longitudinal brace, and the brace 48 is a transverse brace. The brace 40 includes a notch 42 extending upwardly from its bottom surface, and the brace 48 includes a notch 50 extending downwardly from its top surface. The notches 42 and 50 fit together so that the braces 40 and 48 provide a cross lap joint to secure the braces to each other. the illustration in FIG. 6 is typical of the manner in which the longitudinal and transverse braces are respectively secured to each other.

After the longitudinal braces 40 and 44, and the transverse braces 46, 48, and 52 are secured together and are secured in their notches 32 to the walls of the block 14, the top 60 is then appropriately secured to the top surfaces 30 of the block 14 and to the top surfaces of the braces. As indicated above, the tops of the longitudinal and transverse braces are flush with the top surface 30 of the block 14 to provide a unitary, flat surface for supporting the top 60 and to which the top 60 may in turn be secured.

It will be noted that there is an absence of acoustic holes extending through the top 60 to communicate with the acoustic chamber 16. The top 60 accordingly is "solid" without any apertures, and is, of course, designed to fit the block 14 to provide a complete body 12. The top 60 is also relatively thick, but it need not be as thick as the bottom 28 and the walls 18, 20, 22, and 24. The relatively thick top 60 also helps prevent communication between the air within the sound chamber 16 and the air outside the sound chamber.

The top 60 is secured to the block 14. Next, the next 70 is appropriately secured to the body and top assembly 12. The neck 70 includes a tail piece 72, which extends into the notch 36, and by which the neck 70 is appropriately secured to the block and top assembly 12.

At the outer end of the neck 70, remote from the block 12, is a head 90. The head 90 includes six tuning heads 92. As is well known and understood, the purpose of the tuning heads is to secure guitar strings, such as guitar strings 120, shown in FIG. 1, to the head 90. The tuning heads also allow the strings 120 to be stretched appropriately for tuning purposes. Since guitars typically utilize six strings, there are six tuning heads 92.

Disposed over the neck 70, and extending between the block 12 and the head 90 is the fret board 80. The fret board 80 includes a plurality of frets used for pitch changes in relation to the strings 120. The fret board 80 is appropriately secured to the neck 70 and onto the body 12, and, as shown in FIG. 2, over the "upper" portion of the top 60.

As best shown in FIGS. 1, 3, and 7, the bridge 100 extends nearly the full width of the acoustic chamber 16 and nearly the full distance between the side walls 22 and 24 just below the waist 26. The bridge 100 is disposed over the transverse brace 48, and over the center portion of the longitudinal braces 40 and 44. This is best shown in FIGS. 2, 3, and 7. The brace 56, because of its location with respect to the bridge 100 and the acoustic or sound chamber 16, may be considered as a sound bar.

Figure 2:
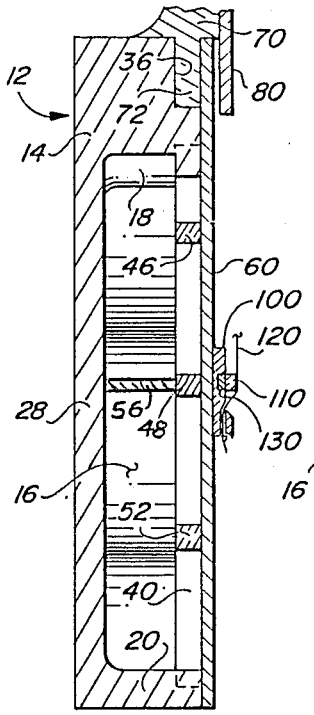
FIG. 2 is a view in partial section taken generally along line 2—2 of FIG. 1.

As shown in FIG. 2, a saddle 110 extends upwardly from the top surface of the bridge 10. The saddle 110 is disposed in a groove in the bridge 100. The strings 120 extend over the saddle 110 and through appropriate apertures in the bridge 100 and are tied thereto to secure the strings 120 to the bridge 100. This is all accomplished in a well known and understood manner. It will be noted, as best shown in FIG. 2, that the saddle 110 is disposed over the brace or sound bar 48.

In the groove in the bridge 100, beneath the saddle 110 is a transducer pickup 130. The transducer 130 is disposed in the bridge beneath the saddle 110 and on the portion of the top 60 above the transverse brace 48. This places the transducer 130 generally in the acoustic center of the guitar and adjacent to the acoustic chamber 16. Vibrations from the strings 120 are transmitted through the saddle 110, the bridge 100, the top 60, and the braces 40 . . . 52 and to the acoustic chamber 16, where appropriate resonance takes place. The resonance is in turn sensed by the transducer and transformed into electrical signals which are appropriately transmitted by conductors (not shown) to an amplifier, speakers, etc., in a well known and understood manner. The electrical controls, comprising well known and understood elements, and not comprising a part of the present invention, have been omitted, for purposes of clarity, from the drawing and the disclosure.

The transducer 130 is a pizzo-electric type, sensitive to the vibrations of the wood induced by the vibrating strings and the wood of the top 60 and bridge 100 and by the vibrations in the air within the sound or acoustic chamber 16.

The heavy or relatively thick walled construction of the body 12, including the relatively heavy interlocking braces 40, 44, 46, 48, 52, and 56 are for the conductance of vibrations to the acoustic center of the guitar. The heavy walled construction also helps control air vibrations and thus helps substantially eliminate the acoustic feedback inherent in standard hollow body acoustic and semi-hollow-body acoustic instruments.

The brace 56 is disposed beneath the saddle 110 and beneath the bridge 100, and preferably between the fourth and fifth strings. The brace 56 is located where the strings cross the saddle. As indicated above, the brace 56 is located at about the acoustic center or focal point of the sound or acoustic chamber 16.

The brace 56 is a multi-purpose element. It helps to stabilize the top 60 and the bottom 28, and it helps transfer vibrations from the top to the bottom. The brace 56 also helps control natural tone characteristics of the apparatus 10.

Another function of the brace 56 is to help control vibration patterns of the top 60 and the bottom 56 by keeping them in a generally parallel relationship. The brace 56 also helps to control feedback from the air vibrations within the chamber 16. The relatively thick walled construction, along with the brace 56, substantially eliminates acoustic feedback.

The vibrations of the strings 120, as with all string instruments, depends on several factors, including the kind of wood used in the guitar apparatus 10, and particularly the wood used for the body 12, including the braces 40 . . . 52, the top 60, and the neck 70 and fret board 80. The bridge 100, its wood, and its overall length between the sides 22 and 24, also affect the vibrations of the strings 120. In turn, the vibration of the strings and the wood(s) used for the various components affect the resonance of the air within the acoustic or sound chamber 16. The transducer 130 is, of course, sensitive to all of the vibrations or resonating effects of the guitar components.

Essentially, there are four different kinds of wood used in the guitar apparatus 10. The body 12 is made of one kind of wood, the top 60 is made of another kind of wood, the neck 70 and the head 90 are integral with each other and are made of a third kind of wood, and the fret board 80 is made of a fourth kind of wood.

The body 12, with its continuous sides or walls 18, 20, 22, and 24, and its integral bottom 28, are integral with each other, carved from a single block 14. Since the body 12 is integral, the grain pattern in the wood of the body is continuous to provide maximum conductance of sound vibrations.

Similarly, the neck 70 and the head 90 are made of a single piece of wood, and thus the wood grain is continuous. This also maximizes the conductance of the sound vibrations.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Guitar apparatus comprising, in combination: body means, including a relatively thick bottom, relatively thick wall means secured to and extending outwardly from the relatively thick bottom, including a top end wall, a bottom end wall, and first and second side walls joining the top and bottom end walls, a relatively thick top secured to the relatively thick wall means, and internal bracing means secured to the relatively thick wall means and to the relatively thick top for supporting the relatively thick top;

a sound chamber disposed within the body means and defined by the relatively thick bottom, the relatively thick wall means, and the relatively thick top whereby the relatively thick bottom, the relatively thick wall means, and the relatively thick top minimize their vibration and prevent communication between air within the sound chamber and air outside the sound chamber, and having an acoustic center at which sound waves generated within the sound chamber are focused;

bridge means secured to the relatively thick top adjacent to the acoustic center of the sound chamber;

neck means secured to the body means, and including a fret board;

head means secured to the neck means;

string means secured to the head means and to the relatively thick top and disposed over the fret board, the neck means, and the bridge means; and pickup means for sensing vibrations generated by the string means, the sound chamber, and the body means.

2. The apparatus of claim 1 in which the bridge means includes a bridge secured to the relatively thick top and extending substantially between the first and second side walls, and a saddle disposed on and secured to the bridge, and the string means extends over the saddle.

3. The apparatus of claim 2 in which the internal bracing means includes a first plurality of bracing elements extending between the top end means and the bottom end means, and a second plurality of bracing elements is secured to the first plurality of bracing elements and extending between the first and second side walls.

4. The apparatus of claim 3 in which one of the bracing elements of the second plurality of bracing elements is disposed adjacent to the acoustic center of the sound chamber.

5. The apparatus of claim 4 in which the bridge means is secured to the relatively thick top adjacent to the one of the bracing elements of the second plurality of bracing elements disposed adjacent to the acoustic center of the sound chamber.

6. The apparatus of claim 5 in which the pickup means is secured to the bridge means adjacent to the acoustic center of the sound chamber.

7. The apparatus of claim 6 in which the pickup means includes a transducer disposed beneath the saddle.

8. The apparatus of claim 5 in which the relatively thick top of the body means is a substantially continuous plate to prevent communication between air within the sound chamber and air outside the sound chamber.

9. The apparatus of claim 1 in which the relatively thick bottom and relatively thick wall means are made out of wood.

10. The apparatus of claim 9 in which the relatively thick wall means is integral with the relatively thick bottom to provide continuity in wood grain to maximize the conductance of sound vibrations.

11. The apparatus of claim 1 in which the neck means and the head means are integral with each other to provide maximum conductance of sound vibrations.

12. The apparatus of claim 1 in which the internal bracing means includes a plurality of braces extending between the top end wall and the bottom end wall and between the first and second side walls.

13. The apparatus of claim 12 in which the plurality of braces of the internal bracing means includes a sound bar disposed over the acoustic center of the sound chamber, and the bridge means is disposed over the sound bar.

14. The apparatus of claim 13 in which the internal bracing means further includes a brace extending between the sound bar and the relatively thick bottom for stabilizing the relatively thick top and the relatively thick bottom.

* * * * *